US007942363B2

(12) United States Patent
Gelli et al.

(10) Patent No.: US 7,942,363 B2
(45) Date of Patent: May 17, 2011

(54) COMBINED PERIPHERAL AND CENTRAL REWINDING MACHINE

(75) Inventors: Mauro Gelli, Lucca (IT); Romano Maddaleni, Pisa (IT); Graziano Mazzaccherini, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 1030 days.

(21) Appl. No.: 10/592,140

(22) PCT Filed: Mar. 15, 2005

(86) PCT No.: PCT/IT2005/000143

§ 371 (c)(1),
(2), (4) Date: Sep. 8, 2006

(87) PCT Pub. No.: WO2005/087639

PCT Pub. Date: Sep. 22, 2005

(65) Prior Publication Data

US 2007/0176039 A1 Aug. 2, 2007

(30) Foreign Application Priority Data

Mar. 18, 2004 (IT) ..... FI2004A0061

(51) Int. Cl.
*B65H 19/28* (2006.01)

(52) U.S. Cl. ..... 242/532.2; 242/533.7; 242/542; 242/581

(58) Field of Classification Search ..... 242/532.2, 242/521, 533.7, 542, 542.1, 542.2, 581, 571, 242/571.1

See application file for complete search history.

(56) References Cited

U.S. PATENT DOCUMENTS

| | | | | | |
|---|---|---|---|---|---|
| 4,327,877 | A | * | 5/1982 | Perini | 242/521 |
| 4,828,195 | A | * | 5/1989 | Hertel et al. | 242/521 |
| 5,267,703 | A | | 12/1993 | Biagiotti | |
| 5,370,335 | A | | 12/1994 | Vigneau | |
| 5,372,331 | A | * | 12/1994 | Miller et al. | 242/571.2 |
| 5,505,405 | A | | 4/1996 | Vigneau | |
| 5,725,176 | A | | 3/1998 | Vigneau | |

(Continued)

FOREIGN PATENT DOCUMENTS

EP 0 524 158 A1 1/1993

(Continued)

OTHER PUBLICATIONS

Kachi Kazufumi: Cutting and Winding Device In Toilet Paper Winder; Patent Abstracts of Japan, vol. 006, No. 146, Aug. 5, 1982 and JP 57-067447 A, Apr. 24, 1982.

(Continued)

*Primary Examiner* — William A Rivera
(74) *Attorney, Agent, or Firm* — Breiner & Breiner, L.L.C.

(57) ABSTRACT

The rewinding machine comprises: a first winding roller (11) and a second winding roller (13) defining a nip (15) through which said cores are inserted and through which said web material (N) is fed; and at least one pair of motorized engaging members (57), to engage the ends of a winding core and transmit a rotational movement to the core during at least part of the winding cycle of each log. The engaging members and the first and second winding roller are produced and disposed so that the log being formed is in contact with said first and said second winding roller. Moreover, a third winding roller (17) is provided, defining a winding space with said first and said second winding roller, said third winding roller being movable to allow increase and completion of winding of each log in said winding space.

66 Claims, 6 Drawing Sheets

U.S. PATENT DOCUMENTS

| | | | | |
|---|---|---|---|---|
| 5,769,352 | A | 6/1998 | Biagiotti | |
| 5,954,291 | A * | 9/1999 | Meinecke et al. | 242/542 |
| 5,979,818 | A | 11/1999 | Perini et al. | |
| 6,050,519 | A | 4/2000 | Biagiotti | |
| 6,179,241 | B1 | 1/2001 | Ba Dour, Jr. et al. | |
| 6,199,789 | B1 * | 3/2001 | Marco | 242/533.7 |
| 6,378,799 | B1 | 4/2002 | Gambini | |
| 6,513,750 | B2 | 2/2003 | Miller | |
| 6,595,458 | B1 * | 7/2003 | Biagiotti | 242/532.2 |
| 6,648,266 | B1 | 11/2003 | Biagiotti et al. | |
| 7,175,127 | B2 * | 2/2007 | Butterworth et al. | 242/542.1 |
| 7,222,813 | B2 * | 5/2007 | Tung-I | 242/521 |
| 7,318,562 | B2 * | 1/2008 | Biagiotti et al. | 242/521 |
| 7,523,884 | B2 * | 4/2009 | Gelli et al. | 242/521 |
| 2004/0099761 | A1 * | 5/2004 | Recami et al. | 242/533.1 |

FOREIGN PATENT DOCUMENTS

| | | | |
|---|---|---|---|
| EP | 0 695 712 | A1 | 2/1996 |
| EP | 0 620 176 | B1 | 4/1998 |
| EP | 0 962 411 | A1 | 12/1999 |
| EP | 0 909 735 | B1 | 5/2002 |
| GB | 1190850 | A | 5/1970 |
| GB | 2 105 688 | A | 3/1983 |
| JP | 59-78055 | | 5/1984 |
| JP | 62-240243 | | 10/1987 |
| JP | 05-1746 | | 1/1993 |
| WO | WO 02/055420 | A1 | 7/2002 |

OTHER PUBLICATIONS

Oma Takayoshi: Winding Apparatus of Paper Sheet Perforated Lengthwise at Regular Interval; Patent Abstracts of Japan, vol. 006, No. 161, Aug. 24, 1982 and JP 57-077147 A, May 14, 1982.

Oma Takayoshi: Paper Taking-Up Apparatus; Patent Abstracts of Japan, vol. 007, No. 275, Dec. 8, 1983 and JP 58-152750 A, Sep. 10, 1983.

Kataoka Akira: Surface Driving-Type Winder; Patent Abstracts of Japan, vol. 009, No. 029, Feb. 7, 1985 and JP 59-172346 A, Sep. 29, 1984.

* cited by examiner

COMBINED PERIPHERAL AND CENTRAL REWINDING MACHINE

TECHNICAL FIELD

The present invention relates to a rewinding machine to wind a web material around winding cores to form logs of wound web material More specifically, the invention relates to a rewinding machine comprising surface winding members, which transmit a rotational movement to the log being formed by means of contact with the outer surface of the log being formed.

STATE OF THE ART

To produce rolls of toilet paper, kitchen towel and the like, one or more plies of tissue paper are unwound from one or more parent reels with large diameter, and predetermined quantities of web material formed by one or more plies are wound on individual tubular winding cores, typically made of cardboard, plastic or the like. The logs thus formed are subsequently cut into small rolls with an axial length equal to the length of the finished and packaged products.

In modern rewinding machines, winding is performed by means of peripheral or surface winding members, typically winding rollers, belts or combinations of these elements. The rotational movement is imparted to the winding core and to the log being formed by these members, which are in contact with the outer surface of the log being formed. Typically, the logs are formed in winding cradles defined by three winding rollers, one of which is movable to allow and control the increase in diameter of the log being formed.

Examples of surface rewinding machines of this type are described in U.S. Pat. No. 5,979,818, GB-B-2105688, EP-A-0524158, U.S. Pat. No. 5,769,352.

U.S. Pat. No. 6,378,799 describes a surface rewinding machine with three rollers, wherein the third roller is supported by a pair of arms oscillating about an axis which in turn is supported by a slide which translates parallel to the direction of increase of the logs in the winding cradle defined by the three rollers. The object of this layout is to obtain an improvement in winding when the diameter of the logs varies.

In older designs of machines, winding takes place by rotating the winding core or winding spindle by means of a central mechanism, that is, by means of a motorized shaft which engages with the spindle or core. Examples of rewinding machines of this type are described in U.S. Pat. No. 6,513,750, U.S. Pat. No. 6,179,241, U.S. Pat. No. 5,725,176.

WO-A-02055420 describes a rewinding machine to wind web material in logs around winding cores, comprising: a first winding roller and a second winding roller defining a nip through which said cores are inserted and through which said web material is fed. Moreover, this machine has at least one pair of motorized engaging members, in the form of motorized centers, to engage the ends of a winding core and transmit a rotational movement to the core during the winding cycle of each log. The engaging members and the first and second winding roller are designed and arranged so that the log being formed is in contact with the winding rollers during winding.

Therefore, this rewinding machine combines the two winding systems, to obtain continuous and high speed production of logs with specific characteristics. Among other things, the system thus conceived offers the advantage of knowing, instant by instant, the exact position of the axis of the log being formed, and therefore of controlling this position. This is due to the fact that the movements of the centers are controlled electronically and therefore the control unit is able to know and/or modify this position in any instant of the winding cycle. Moreover, as rotation of the centers about the axis thereof can also be controlled, for example, in speed, the system allows balancing of the winding torque transmitted to the log by the winding rollers and the winding torque transmitted by the centers, to prevent reciprocal slippage between the outer turns and the inner core. These operating characteristics are particularly advantageous when winding soft logs, that is, with low density and/or when winding a highly embossed paper web material.

OBJECTS AND SUMMARY OF THE INVENTION

The object of the present invention is to produce a rewinding machine of the type indicated above, with a combination of peripheral and central winding means, which makes it possible to obtain advantages, for example, in terms of product quality, constructional simplicity and efficiency in controlling winding.

Essentially, according to a first aspect, the invention combines a winding cradle formed of three winding rollers, one of which is movable to allow increase of the log being formed, with a system of motorized centers which impart, during at least part of the winding cycle of each log, part of the winding torque to said log. By using three rollers in combination with the centers or other pair of motorized members to engage the ends of the winding core, improved control of the winding cycle is obtained. In this way, the engaging members of the winding core can also be disengaged before winding is complete and/or engaging of the core by said members can be delayed with respect to the instant in which winding starts. Among other things, this makes machine management more flexible, and also offers the possibility of providing a single pair of engaging members.

According to an advantageous embodiment, the third winding roller is supported by at least one arm oscillating about a first axis of oscillation, associated with which is a first actuator to control oscillation of said first arm. Moreover, preferably the first axis of oscillation is supported by a movable element, and in particular by a second arm oscillating about a second axis of oscillation and with which a second actuator is associated to control oscillation of the second arm.

The first and the second axes of oscillation are parallel to each other. This layout allows the axis of the third winding roller to move during winding, along a direction parallel to the direction of increase of the log, keeping the axis of the third winding roller on the plane which also contains the axis of the log. With respect to other configurations, which allow analogous movement during winding, the use of a double oscillating arm allows further advantages to be attained. On the one hand the mechanical system is simpler and can be more easily and rapidly controlled. Moreover, when the log has been completed and must be unloaded, the third winding roller must be moved away from the position thereof to create the space required to unload the log and immediately subsequent to this must be returned towards the nip between the first and second winding roller to come into contact with the next log being formed. The use of a mechanism with a double oscillating arm allows this operation to be performed extremely rapidly. Considering that the winding cycle of a log lasts for only a few seconds (about 2-3 seconds in modern rewinding machines), the speed at which the third winding roller moves from the final winding position of a log to the initial winding position of the next log is an essential element for correct operation of the machine and in order to obtain high production speeds.

In fact, it must be taken into account that the feed speed of the web material towards the winding area is not decreased during the exchange phase, that is, the phase in which the web material is severed, the completed log unloaded and the initial free end formed by severing the web material is made to adhere to the subsequent winding core to start the subsequent winding cycle. In substance, the feed speed of the web material remains essentially constant during the various and subsequent winding cycles of the various logs.

With a layout of the winding roller supported by a system of articulated arms as defined above, the third winding roller can advantageously be held in a position in which it is equidistant from the first and from the second winding roller for most of the winding cycle. In other words, the three contact points of the rollers with the log are at the level of the vertices of an isosceles triangle, the base of which is defined by the line joining the centers of the first and of the second winding roller.

In practice, the movement of the third winding roller is controlled so that it follows the increasing line of the log, that is the line along which the axis of the increasing log moves. Preferably, this line is a straight line, which can be obtained using a first and a second winding roller with the same diameter.

The aforesaid layout allows optimum control of winding and a final product of high quality to be obtained, especially for winding very voluminous products. The presence of three winding rollers allows precise identification of the position of the log and the axis thereof, so that engaging of the winding core by said engaging members is facilitated, also when said engaging takes place after winding of the respective log has started.

The geometry of the winding rollers and the provision of a movable winding roller supported by at least one oscillating arm (or preferably by a pair of oscillating arms), the axis of oscillation of which is in turn connected to another oscillating arm or to a pair of oscillating arms, can also be used advantageously when winding is of the exclusively surface or peripheral type, that is, when there are no members to engage the winding cores and draw them in rotation. In particular, the advantage is obtained of being able to maintain the distance of the third winding roller constant with respect to the first and to the second winding roller with a construction that allows rapid transfer of the third roller from the position of unloading of the completed log to the position of initial winding of the subsequent log.

Thanks to the use of a group of three winding rollers, it is possible to provide a single pair of members to engage the winding cores. In fact, these engaging members or centers can also engage the winding core in an instant subsequent to the one in which insertion of the core in the winding area starts and/or can disengage from the winding core before winding has been completed. The first and/or the last phase of the winding cycle of each log can, in fact, take place under the exclusive control of the winding rollers, without the contribution of the engaging members of the winding core. This simplifies the machine from a constructional and control viewpoint, to the advantage of economy and functionality.

Preferably, in this case the engaging members are arranged and controlled to engage each core after it has been carried in rotation and into contact with the web material. Moreover, or alternatively, advantageously the engaging members are designed and arranged to disengage from the core before winding of the log has been completed.

In a way known per se, the rewinding machine can comprise a core inserter to insert the winding cores sequentially towards the nip between the first and the second winding roller, each core inserted by said inserter being subsequently engaged by the engaging members. A preferred embodiment of the invention is provided with a rolling surface, extending around the first winding roller upstream of the nip between the first and the second winding roller. The core inserter is arranged and designed to insert the cores between the first winding roller and the rolling surface, while the engaging members are produced and disposed to engage each core downstream of the rolling surface.

In a possible embodiment, each of said engaging members includes at least one inflatable chamber to clamp the winding core. The inflatable chamber is, for example, an annular chamber, disposed on the outside of a revolving head, which is inserted into the end of the winding core and expansion of the inflatable chamber causes clamping on the inner surface of the tubular winding core. It would also be possible to provide other reciprocal engaging mechanisms between the centers, or other engaging members, and the winding core. To increase the reliability of clamping, two adjacent annular inflatable chambers are preferably used.

In a possible embodiment, the head carrying the inflatable chamber or chambers is mounted on a rotating axle, connected to a pressurized fluid source, said head being provided with an axial insertion and extraction movement with respect to the winding cores. Moreover, the head can be torsionally coupled to a rotating sleeve drawn in rotation to make said head rotate.

According to a different aspect, the invention relates to a rewinding machine to produce logs of web material, comprising a first winding roller, a second winding roller and a third winding roller defining a winding space, wherein the third winding roller is supported by at least one first arm oscillating about a first axis of oscillation, said at least one first oscillating arm being associated with a first actuator to control oscillation of said at least one first oscillating arm. Characteristically the first axis of oscillation is supported by at least one second arm oscillating about a second axis of oscillation, parallel to the first axis of oscillation, said at least one second oscillating arm being associated with a second actuator to control oscillation of the second oscillating arm.

BRIEF DESCRIPTION OF THE DRAWINGS

The invention shall be better understood by following the description and the accompanying drawing, which shows a non-limiting practical embodiment of the invention. Identical numbers indicate identical or equivalent parts in the various figures. In the drawing.

DETAILED DESCRIPTION OF THE PREFERRED EMBODIMENT OF THE INVENTION

Figure 1:
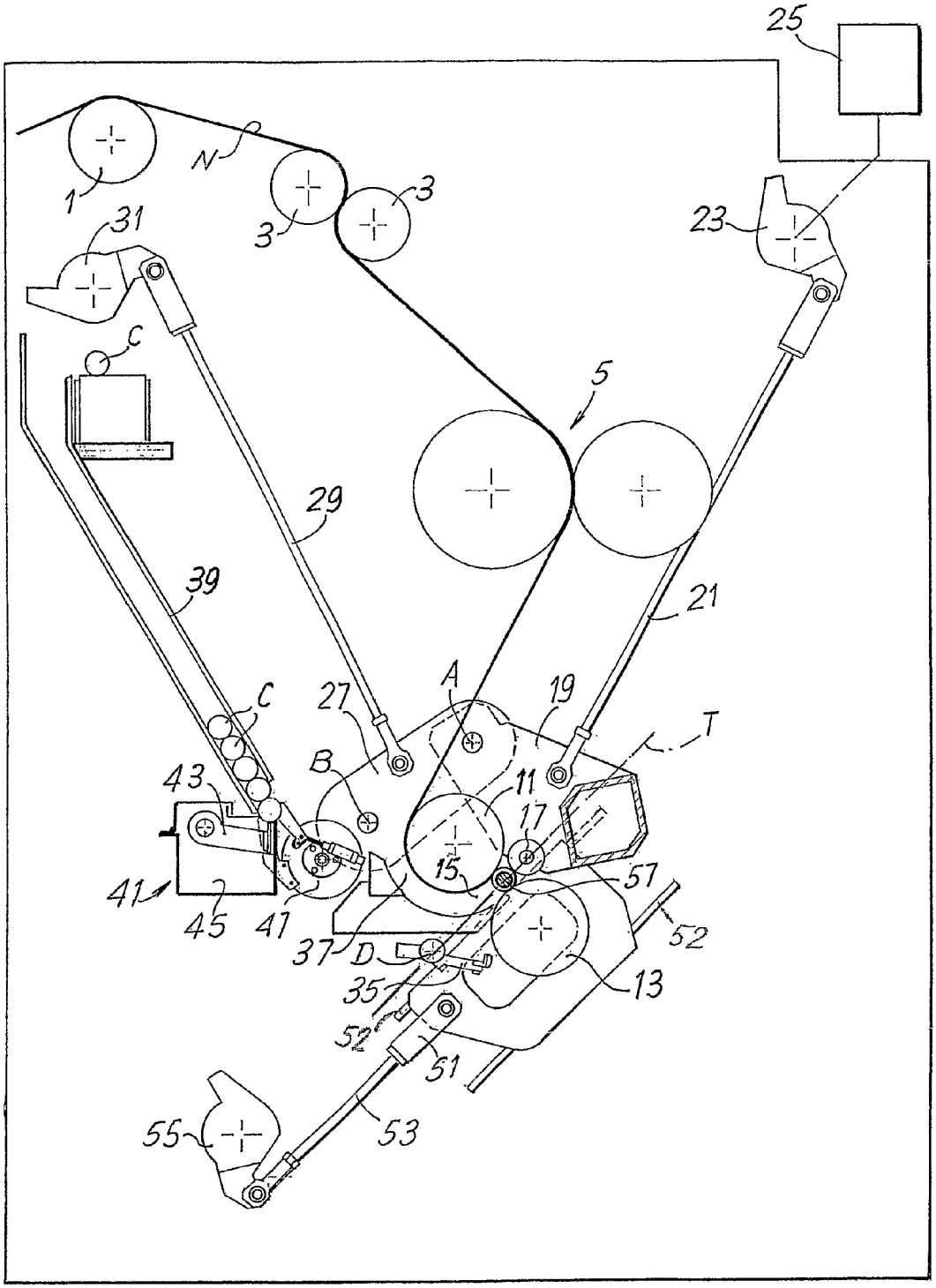
FIG. 1 shows a side view of a rewinding machine according to the invention.
Figure 1A:
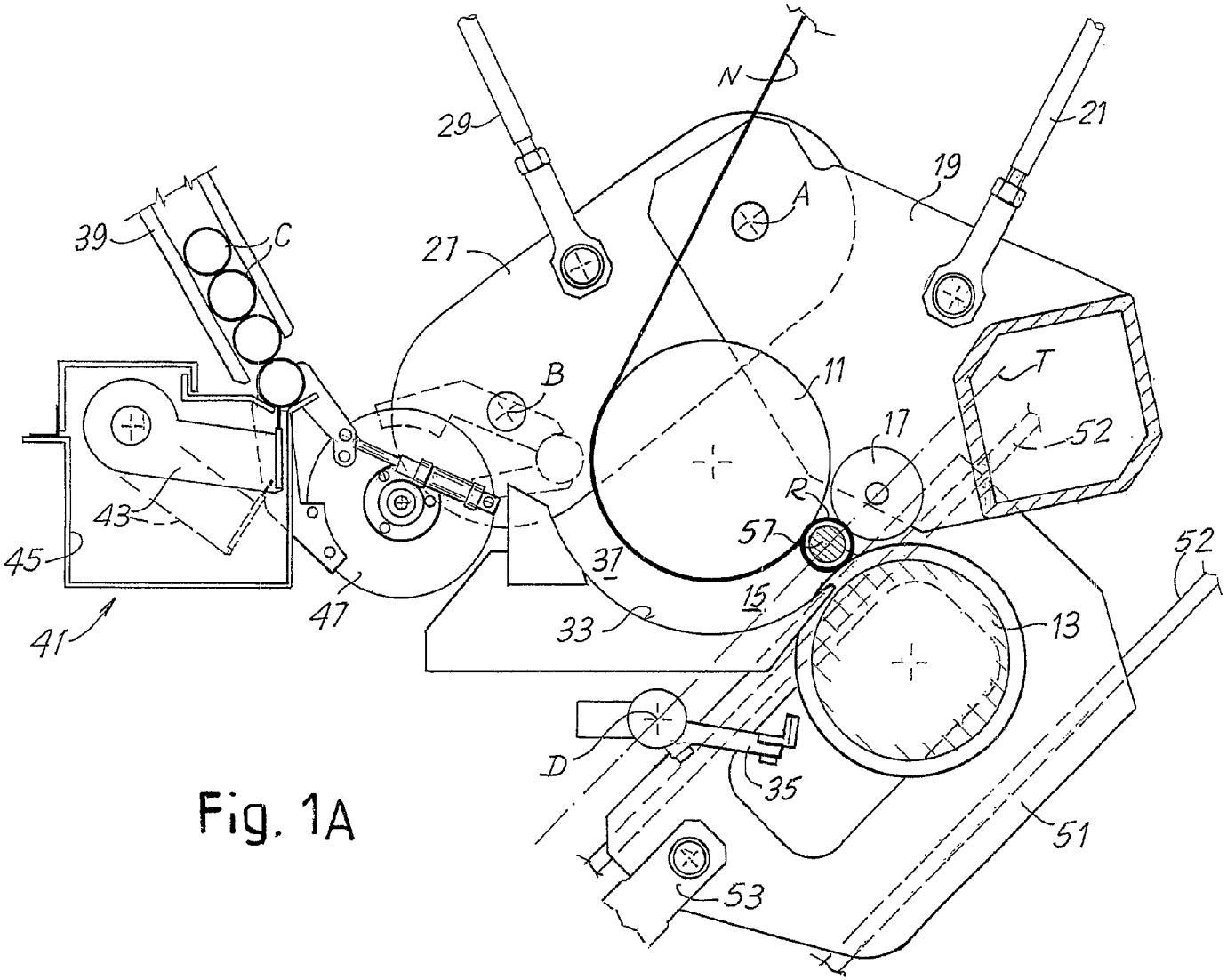
FIG. 1A shows an enlargement of the winding area.

FIG. 1 shows a schematic side view of a possible configuration of a rewinding machine according to the invention. It comprises a path for a web material N to be wound, along which a spreader roller 1 and a pair of feed and guide rollers 3 are disposed. Disposed downstream thereof is a perforating unit 5 of known type, not described in greater detail herein. The perforating unit produces equidistant perforation lines on the web material N, which divide said material into a plurality of individual sections or sheets which the final user can separate along the perforation lines.

A winding system is disposed downstream of the perforating unit 5. This system includes a first winding roller 11, about which the web material N is fed. The first winding roller 11 forms, with a second winding roller 13, a nip 15, through which the web material travels and through which the winding cores also travel. The first and the second winding roller 11, 13, also form, with a third winding roller 17, a winding cradle to form the logs R of web material N. The two winding rollers 11 and 13 have the same diameter, which is greater than the diameter of the third winding roller 17.

The third winding roller 17 is supported by a pair of oscillating arms 19, hinged about a first axis of oscillation A. Oscillation of the arms 19 is obtained, through a rod 21, by means of an actuator 23 controlled electronically by a control unit indicated schematically with 25.

The axis of oscillation A of the pair of arms 19 is supported by a pair of arms 27, to which the arms 19 are hinged. The arms 27 oscillate about an axis B, parallel to the axis A, and oscillation is controlled by means of a rod 29 by an actuator 31, connected to the control unit 25. The oscillation movement of the two pairs of arms 19 and 27 is synchronized in the manner described hereunder. The axis of oscillation B of the arms 27 is on one side of the plane containing the axes of the winding rollers 11 and 13, while the axis A is on the other side.

A rolling surface 33, defined by a series of parallel thin plates, extends around the first winding roller 11. The rolling surface 33 is essentially coaxial to the winding roller 11 and is used for insertion of the winding cores on which the logs R are formed. Rotating about an axis D, parallel to the axes of rotation of the winding rollers, is a severing device for the web material, indicated as a whole with 35, the operation of which is known to those skilled in the art and described in detail in EP-B-0694020 and in U.S. Pat. No. 5,979,818.

The rolling surface 33 defines, with the outer surface of the first winding roller 11, a channel for insertion of the cores, the transverse dimension of which (defined by the distance between the cylindrical surface of the roller 11 and the rolling surface 33) is equal to or slightly lower than the diameter of the winding cores. In practice, as winding of the first turns around the winding core commences in said channel, the transverse dimension of the channel may vary slightly along the extension thereof and be chosen so that in all points it is equal to or slightly below the dimension of the diameter of the core, increased by the thickness of the web material wound thereabout in all positions of said channel. The transverse dimension slightly below that of the core allows a slight deformation to be produced through the radial compression of the core to keep it correctly under control.

The channel, indicated with 37, has an inlet end into which the cores are inserted, and an outlet end, at the level of the nip 15 between the winding rollers 11 and 13.

In the example illustrated the winding cores C are fed from a channel 39 towards a gluing unit 41, comprising a blade 43 which is immersed in a glue tank 45 and emerges therefrom to apply a longitudinal line of glue on the cores C. The individual cores C, equipped with glue, are inserted by an inserter 47 into the inlet of the channel 37. Once inserted in the channel, the cores C are accelerated angularly and start to roll on the surface 33, in contact with the web material N fed around the winding roller 11.

Disposed on the two sides of the rewinding machine are two carriages or slides 51, sliding along guides 52 integral with the side panels 54 (FIG. 5) with alternate motion controlled by means of a rod 53 by an actuator 55 controlled by the control unit 25. Disposed on each of the two carriages 51 is an engaging member or center 57 which is inserted into the respective end of a winding core C when this is in the log winding area. The movement of the carriages 51 makes the centers 57 follow the core C in the movement it performs during increase of the log. This movement follows a rectilinear trajectory indicated with T. The axis of the third winding roller 17 also moves along this trajectory. The layout of the two pairs of arms 19, 27 and control of the movement thereof imparted by the respective actuators is such that the contact point of the roller 17 with the log R being formed always remains on the straight line T, so that the log R is in contact with the three winding rollers 11, 13 and 17 in three areas corresponding to the vertices of an isosceles triangle, the base of which is the line joining the contact points with the first and the second winding roller 11, 13.

Figure 3A:
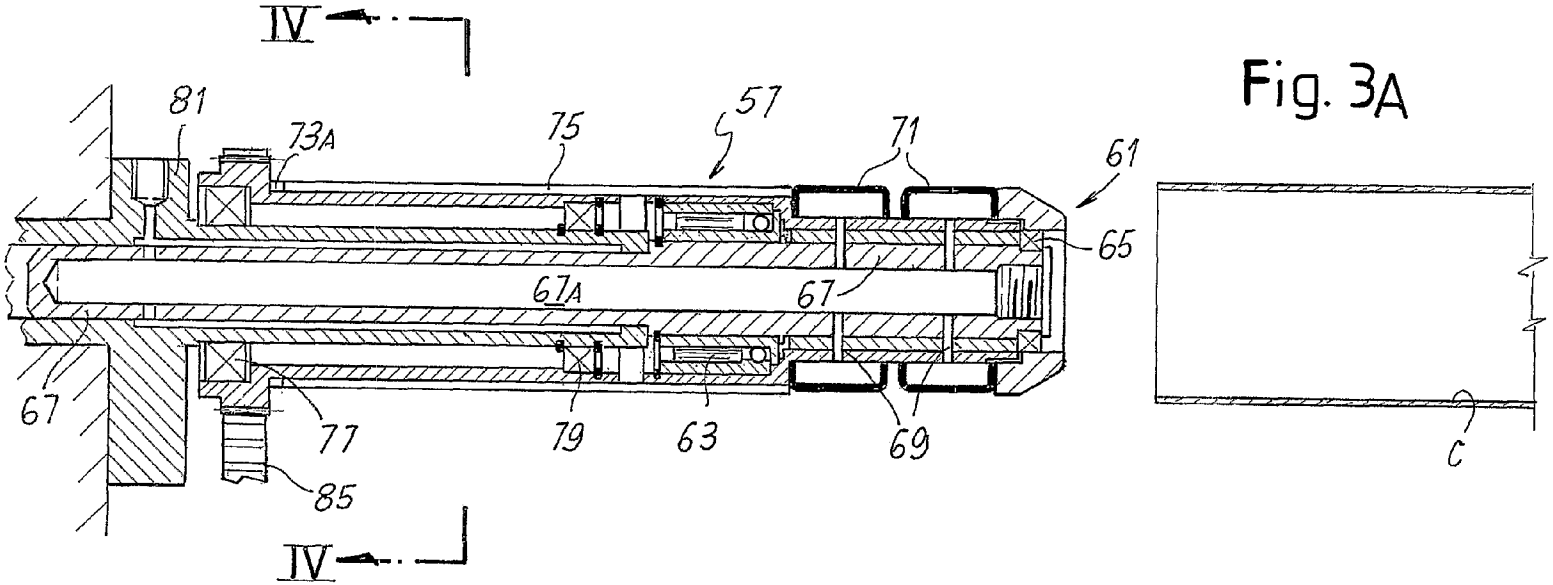
FIGS. 3A and 3B show a longitudinal section of one of the centers or engaging members of the winding core in two distinct positions.
Figure 3B:
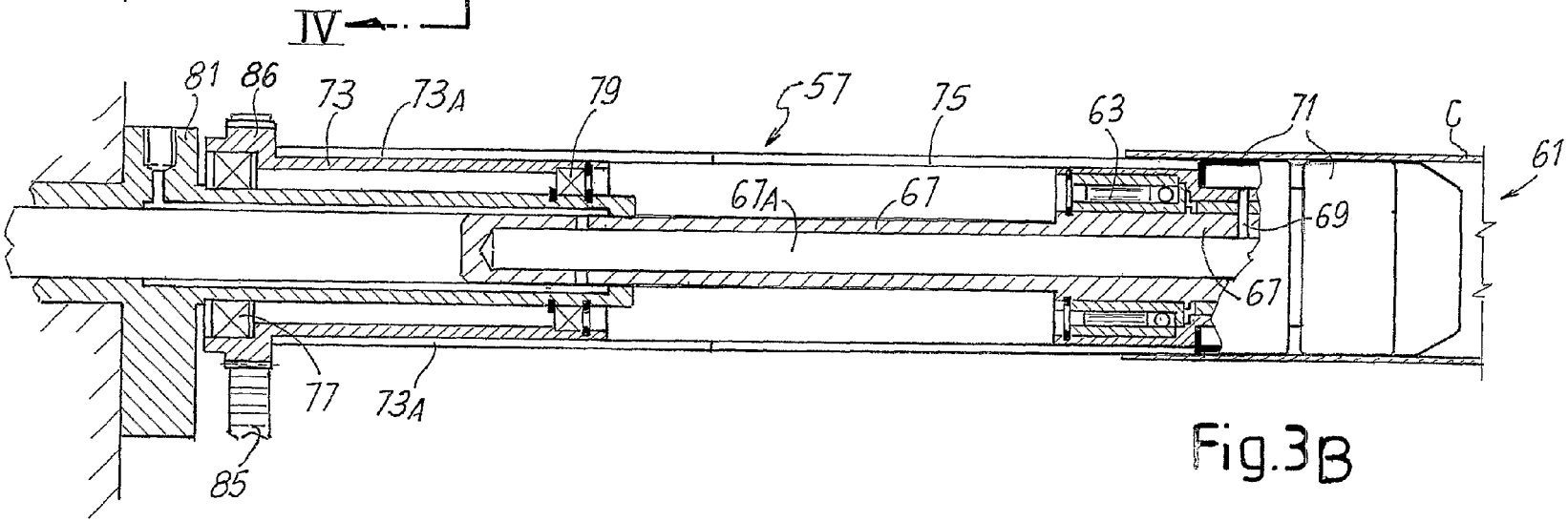
Figures 4, 5:
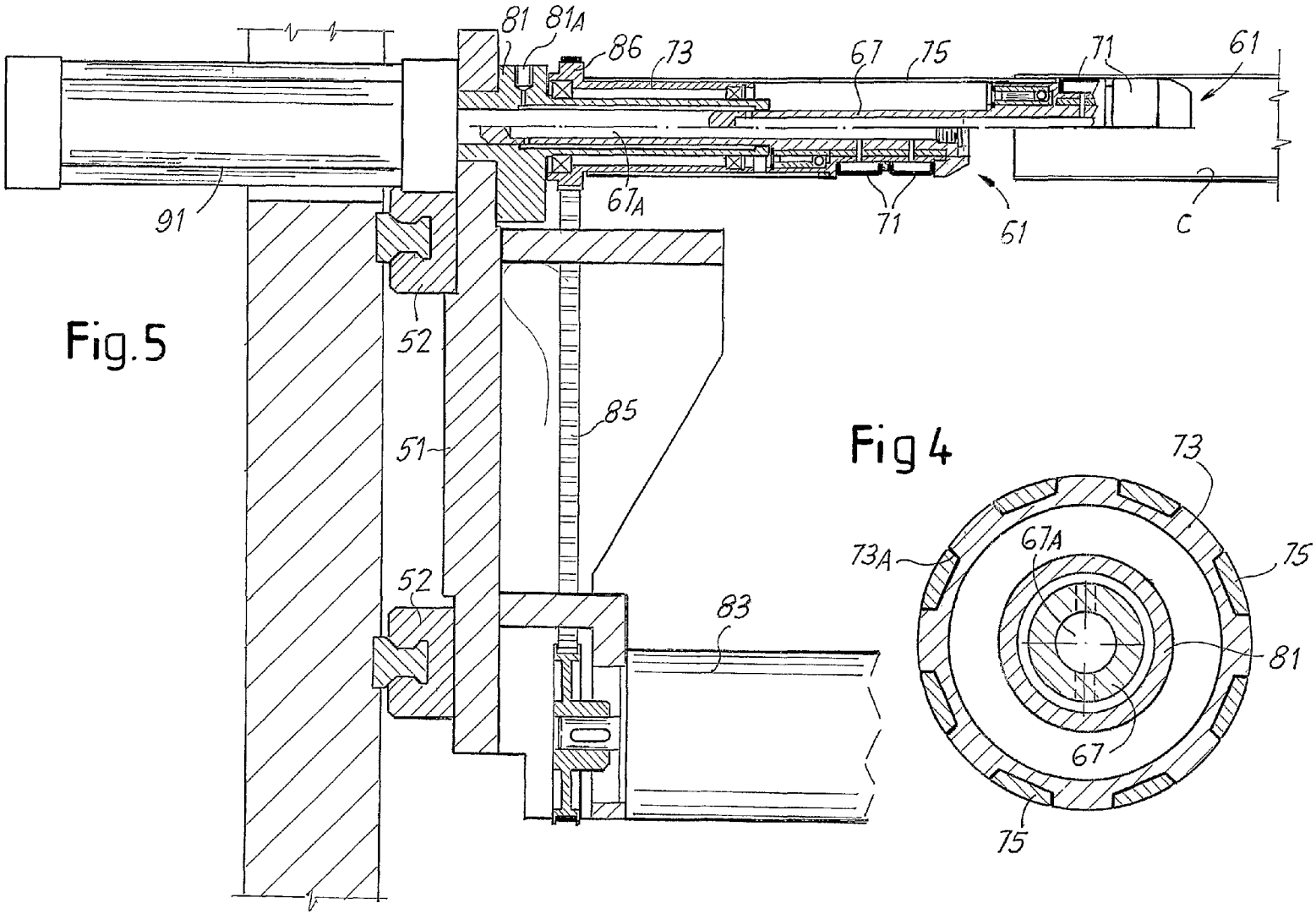
FIG. 4 shows a local section according to IV-IV in FIG. 3.
FIG. 5 shows a section according to V-V in FIG. 1A.

The centers 57 are essentially symmetrical and one of them is shown in detail in FIGS. 3 and 4, while the carriage or slide 51 carrying it, with relative actuators, is shown in FIG. 5.

FIGS. 3A and 3B show the center in the two positions engaged and disengaged with respect to the winding core C.

The center has a head 61 supported by bearings 63 and 65 on a hollow shaft 67 movable axially but not rotating. The inside 67A of the hollow shaft 67 is connected, by ducts 69, to two annular inflatable chambers 71 parallel with each other mounted on the head 61. These inflatable chambers are used to engage the head 61 torsionally with the respective end of the winding core C, expanding against the inner surface of said core C.

The head 61 slides axially to be inserted into and extracted from the core C and is engaged torsionally by means of a grooved profile to a sleeve 73 provided with a grooved profile 73A in which rods 75 integral with the head 61 engage. The sleeve 73 is supported by bearings 77, 79 on a fixed axis 81 and is drawn in rotation by a motor 83 by means of a belt 85 (FIG. 5) fed around a toothed wheel 86 integral with the sleeve 73. In this way, the motor 83 carries the head 61 in rotation with an angular velocity determined as a function of the angular velocity with which the core C and the log being formed thereabout are carried in rotation by the rollers 11, 13 and 17. The angular velocity of the head 61 can be equal to the angular velocity imparted to the log by the winding rollers 11, 13, 17. However, it can also be slightly different, to produce controlled angular sliding of the core with respect to the outermost turn of web material being wound.

The hollow shaft 67, on which the head 61 is revolvingly supported, slides inside the fixed axle 81. The axle 81 has a duct 81A for feeding compressed air into the inflatable chambers 71. The pressurized air fed through the duct 81A reaches the inside of the hollow shaft 67 through radial holes 67A in said shaft.

The head 61 slides axially thanks to the fact that the hollow shaft 67 is integral with the rod of a piston-cylinder actuator 91 or itself forms the rod of said actuator (FIG. 5). The axial movement allows insertion of the head 61 into the corresponding end of the winding core C and its extraction therefrom.

Operation of the rewinding machine described above shall now be illustrated with reference to FIGS. 2A-2D.

Figure 2A:
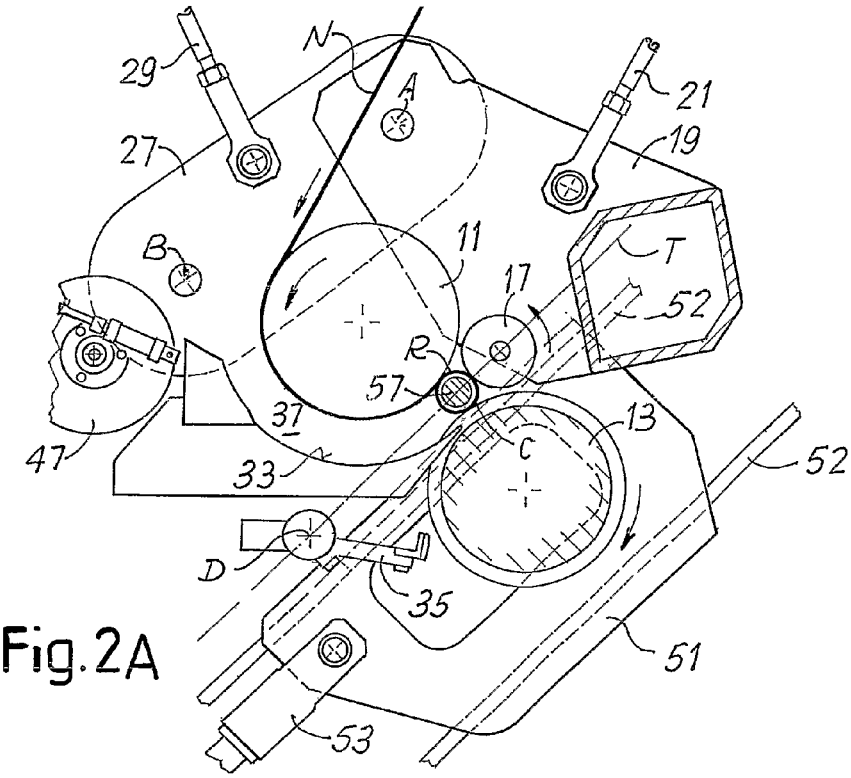
FIGS. 2A-2D show four instants of the winding cycle of a single log.
Figure 2B:
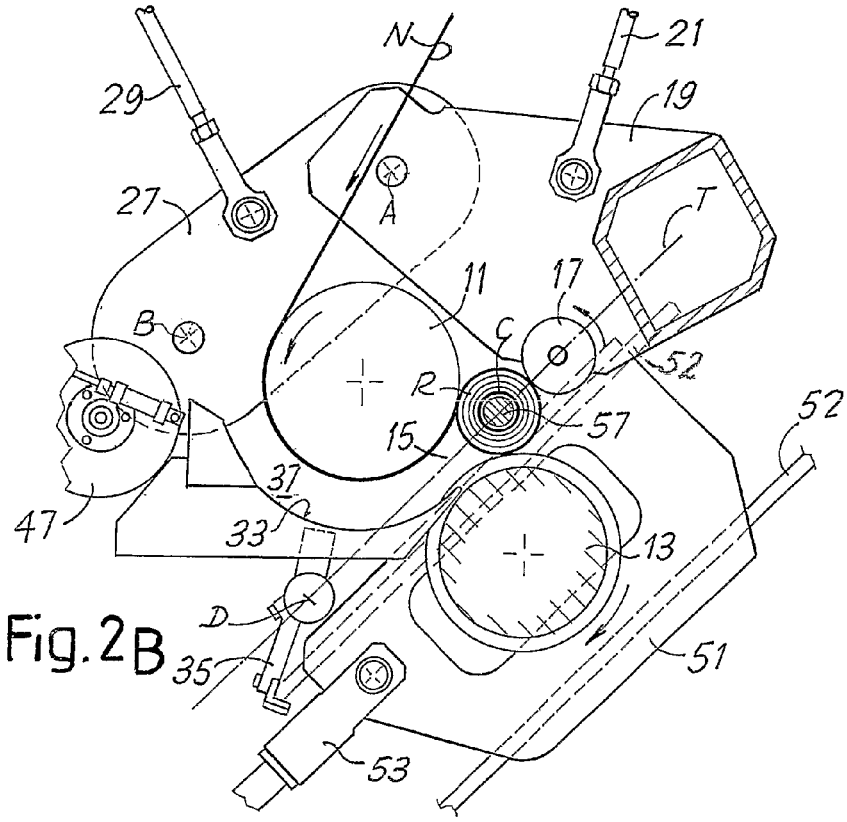

In FIG. 2A a winding core C has been inserted in the channel defined by the winding roller 11 and by the rolling surface 33 and has been fed to the nip between the winding rollers 11 and 13. The web material N has been severed by the device 35 and the head or initial free end thus formed has been made to adhere, by means of the glue applied by the dispenser 41, to the core C. The final free end has been wound on the previously formed log, which has been unloaded from the winding cradle.

In the nip 15 the engaging members or centers 57 are inserted into the respective ends of the core C and the inflatable chambers 71 are expanded to block the heads 61 in the core C. Insertion of the two centers can take place in a subsequent instant, for example in the condition in FIG. 2B. The first phase of the winding cycle of the log R takes place, in this case, by keeping the log in rotation by means of the action of the winding rollers 11, 13 and 17 alone.

By means of the respective motors 83 the heads 61 of the centers 57 are carried to the suitable rotation speed before insertion into the ends of the winding core C. The exact position of the winding core and the rotation speed thereof are known to the control unit 25, which can consequently control movement of the centers 57 with precision.

When the core has left the nip 15 winding of the log R continues in the winding cradle defined by the rollers 11, 13 and 17 under the control of said rollers and of the motorized centers 57. As the log R increases in diameter, the third winding roller 17 moves along the straight line T, along which the centers 57 also move, to follow the increase in the log R. Movement of the roller 17 is obtained by means of the combination of oscillations of the arms 19, 27 about the axes A and B.

Figure 2C:
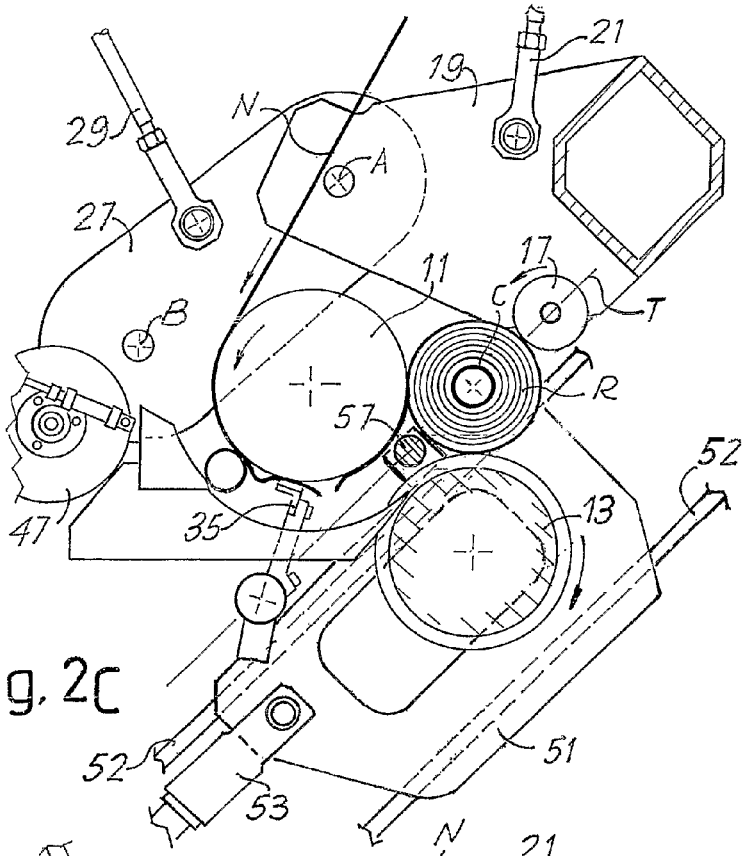

Before winding is completed, the centers 57 disengage from the core C and return towards the nip 15 through an inverse translatory movement to the one with which they followed the log R in the increasing phase thereof. For example, the centers 57 can disengage and return to the area of the nip 15 when the log R has almost reached the final diameter thereof, as shown in FIG. 2C, but is not yet finished. Winding of the log is completed between the rollers 11, 13, 17 while the centers 57 move back towards the nip 15 to engage a new core which is inserted in the channel between the roller 11 and the rolling surface 33.

Figure 2D:
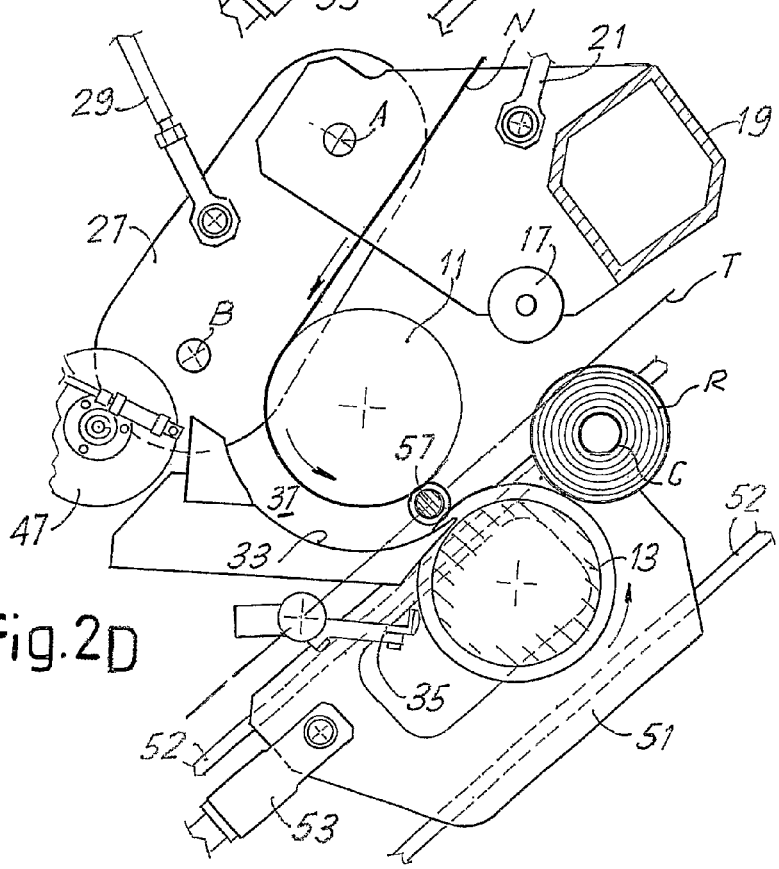

Once the log R has been completed it is unloaded from the winding cradle by moving the axis of the winding roller 17 from the straight line T, forming an aperture between the roller 17 and the roller 13 (FIG. 2D) through which the completed log is ejected. Ejection of the log takes place in a know way by acting on the peripheral speeds of the winding rollers 13 and 17, increasing the peripheral speed of the roller 17 with respect to the peripheral speed of the roller 13 and/or reducing the speed of the roller 13 with respect to that of the roller 17. This deceleration also causes the new core C to be fed through the nip 15. In the meantime, the initial free end produced by severing the web material N has been attached to said core, and the engaging members 57 are inserted in the ends thereof to control the first winding phase of the new log. FIG. 2D also shows the new core, indicated with C2, which starts to roll along the channel 37 to reach the nip 15 and replace the completed log R.

It is understood that the drawing merely shows a possible embodiment of the invention, which may vary in forms and layouts without however departing from the scope of the concept on which the invention is based. Any reference numerals in the appended claims are provided purely to facilitate reading in the light of the description hereinbefore and of the accompanying drawings, and do not limit the scope of protection whatsoever.

The invention claimed is:

1. A rewinding machine for winding web material in logs about winding cores, comprising a first winding roller and a second winding roller defining a nip through which winding cores are inserted and through which web material is fed; and at least one pair of motorized engaging members constructed and arranged to engage ends of a winding core and transmit a rotational movement to the winding core during at least a part of a winding cycle of each log, said engaging members and said first winding roller and said second winding roller being constructed and arranged so that a log being formed is in contact with said first winding roller and said second winding roller; wherein said rewinding machine further includes a third winding roller, defining a winding space with said first winding roller and said second winding roller, said third winding roller is supported by at least a first arm oscillating about a first axis of oscillation, said first axis of oscillation being carried by a movable element, said third winding roller being movable to allow increase and completion of winding of each log in said winding space.

2. The rewinding machine as claimed in claim 1, wherein a first actuator to control oscillation of said first arm is associated with said first arm.

3. A rewinding machine for winding web material in logs about winding cores, comprising a first winding roller and a second winding roller defining a nip through which winding cores are inserted and through which web material is fed; and at least one pair of motorized engaging members constructed and arranged to engage ends of a winding core and transmit a rotational movement to the winding core during at least a part of a winding cycle of each log, said engaging members and said first winding roller and said second winding roller being constructed and arranged so that a log being formed is in contact with said first winding roller and said second winding roller; wherein said rewinding machine further includes a third winding roller, defining a winding space with said first winding roller and said second winding roller, said third winding roller being movable to allow increase and completion of winding of each log in said winding space, wherein said third winding roller is supported by at least a first arm oscillating about a first axis of oscillation, wherein a first actuator to control oscillation of said first arm is associated with said first arm, wherein said first axis of oscillation is supported by at least a second arm oscillating about a second axis of oscillation, and wherein a second actuator is associated to said second arm to control oscillation thereof, said first axis of oscillation and said second axis of oscillation being substantially parallel to each other.

4. The rewinding machine as claimed in claim 3, wherein with respect to a plane containing axes of rotation of the first winding roller and of the second winding roller, said first axis of oscillation is arranged on an unloading side of the logs, while the second axis of oscillation is arranged on an opposite side of said plane.

5. The rewinding machine as claimed in claim 3, wherein said first oscillating arm and said second oscillating arm are controlled during at least a part of the winding cycle of a log, so that contact areas of the first winding roller, the second winding roller and the third winding roller with the log being formed are disposed at vertices of an isosceles triangle.

6. The rewinding machine as claimed in claim 5, wherein said third winding roller is in contact with the log in an area essentially equidistant from a contact area of said log respectively with the first winding roller and with the second winding roller, for approximately an entire winding phase during which the log is in contact with the first winding roller, the second winding roller and the third winding roller.

7. The rewinding machine as claimed in claim 3, wherein said first oscillating arm and said second oscillating arm are disposed and controlled so that, during at least a portion of the winding cycle of each log, axis of the third winding roller translates along a straight line along which an axis of the log being wound moves.

8. The rewinding machine as claimed in claim 3, including a single pair of said engaging members.

9. The rewinding machine as claimed in claim 3, wherein the engaging members are disposed and controlled to engage each core after the core has been brought into rotation and into contact with the web material.

10. The rewinding machine as claimed in claim 3, wherein the engaging members are constructed and arranged to disengage from a core before winding of a log on the core has been completed.

11. The rewinding machine as claimed in claim 3, further comprising a core inserter to sequentially insert the winding cores into the nip between the first winding roller and the second winding roller, each core inserted by said core inserter being subsequently engaged by said engaging members.

12. The rewinding machine as claimed in claim 11, further comprising a rolling surface extending around said first winding roller upstream of said nip, said core inserter being constructed and arranged to insert the cores between the first winding roller and the rolling surface, said engaging members being controlled to engage each core downstream of said rolling surface or at a level of an end area of the rolling surface.

13. The rewinding machine as claimed in claim 3, wherein each of said engaging members comprises at least one inflatable chamber to clamp the winding core.

14. The rewinding machine as claimed in claim 13, wherein said at least one inflatable chamber has an annular extension.

15. The rewinding machine as claimed in claim 13, wherein said at least one inflatable chamber is arranged on a head supported revolvingly on a fixed hollow central shaft, connected to a source of pressurized fluid, said head being provided with an axial movement of insertion and extraction with respect to the winding cores.

16. The rewinding machine as claimed in claim 15, wherein said head is torsionally coupled to a rotating sleeve drawn in rotation to make said head rotate.

17. The rewinding machine as claimed in claim 16, wherein said rotating sleeve and said head are coupled by a splined coupling.

18. A rewinding machine for winding web material in logs about winding cores, comprising a first winding roller and a second winding roller defining a nip through which winding cores are inserted and through which web material is fed; and at least one pair of motorized engaging members constructed and arranged to engage ends of a winding core and transmit a rotational movement to the winding core during at least a part of a winding cycle of each log, said engaging members and said first winding roller and said second winding roller being constructed and arranged so that a log being formed is in contact with said first winding roller and said second winding roller; wherein said rewinding machine further includes a third winding roller, defining a winding space with said first winding roller and said second winding roller, said third winding roller being movable to allow increase and completion of winding of each log in said winding space, wherein each of said engaging members comprises at least one inflatable chamber to clamp the winding core.

19. The rewinding machine as claimed in claim 18, wherein said at least one inflatable chamber has an annular extension.

20. The rewinding machine as claimed in claim 18, wherein said at least one inflatable chamber is arranged on a head supported revolvingly on a fixed hollow central shaft, connected to a source of pressurized fluid, said head being provided with an axial movement of insertion and extraction with respect to the winding cores.

21. The rewinding machine as claimed in claim 20, wherein said head is torsionally coupled to a rotating sleeve drawn in rotation to make said head rotate.

22. The rewinding machine as claimed in claim 21, wherein said rotating sleeve and said head are coupled by a splined coupling.

23. A method for winding logs of web material around winding cores, including steps of:

inserting a first winding core through a nip between a first winding roller and a second winding roller, winding a predetermined quantity of web material around said winding core carried in rotation to form a first log, controlling rotation of the core and of the log being formed during the winding by said first winding roller and said second winding roller and by a pair of engaging members of the winding core;

upon end of the winding, severing the web material, producing a final free end and an initial free end;

starting to wind the web material around a second winding core;

wherein during at least a part of the winding, controlling rotation of said log by a third winding roller which defines a winding space with the first winding roller and the second winding roller, said third winding roller being supported by at least a first arm oscillating about a first axis of oscillation, said first axis of oscillation being carried by a movable element.

24. The method as claimed in claim 23, wherein said engaging members of the winding core disengage from the winding core before the winding of the log is completed, the winding being completed between said first winding roller, said second winding roller and said third winding roller, while said engaging members are transferred towards a point to engage a subsequent core.

25. The method as claimed in claim 24, wherein the winding core is carried in rotation before engagement of the core with said engaging members.

26. The method as claimed in claim 23, wherein the winding core is carried in rotation before engagement of the core with said engaging members.

27. The method as claimed in claim 23, wherein said winding core is carried into contact with the web material before engagement of the core with said engaging members.

28. The method as claimed in claim 23, wherein said winding cores are engaged by a single pair of engaging members, which are disengaged from a log during forming before completion of the winding and return to an engaging position to engage a subsequent winding core.

29. A method for winding logs of web material around winding cores, including steps of:

inserting a first winding core through a nip between a first winding roller and a second winding roller, winding a predetermined quantity of web material around said winding core carried in rotation to form a first log, controlling rotation of the core and of the log being formed during the winding by said first winding roller and said second winding roller and by a pair of engaging members of the winding core;

upon end of the winding, severing the web material, producing a final free end and an initial free end; and starting to wind the web material around a second winding core;

wherein during at least a part of the winding, controlling rotation of said log by a third winding roller with a movable axis which defines a winding space with the first winding roller and the second winding roller, wherein said third winding roller is supported by a first arm oscillating about an axis supported by a second arm in turn oscillating about a fixed axis.

30. The method as claimed in claim 29, wherein said first oscillating arm and said second oscillating arm are controlled during at least a part of the winding of a log, so that the first winding roller, the second winding roller and the third winding roller are in contact with said log at a level of areas disposed essentially at a level of vertices of an isosceles triangle along a circumferential extension of the log.

31. The method as claimed in claim 29, wherein a contact area between the log and said third winding roller is equidistant from the contact area of the log respectively with the first winding roller and the second winding roller, for approximately an entirety of the winding during which the log is in contact with the first winding roller, the second winding roller and the third winding roller.

32. A rewinding machine for winding web material in logs about winding cores, comprising a first winding roller and a second winding roller defining a nip through which winding cores pass and through which web material is fed; and core engaging members, said engaging members and said first winding roller and said second winding roller being constructed and arranged so that a log being formed is in contact with said first winding roller and said second winding roller over at least part of a winding cycle; and wherein said rewinding machine further comprises a third winding roller defining a winding space with said first winding roller and said second winding roller, said third winding roller is supported by at least a first arm oscillating about a first axis of oscillation, said first axis of oscillation being carried by a movable element, and said third winding roller being movable to allow increase of each log in said winding space.

33. The rewinding machine as claimed in claim 32, including two core engaging members constructed and arranged to engage said winding core at a first side and a second side thereof.

34. The rewinding machine as claimed in claim 33, wherein said core engaging members are driven into rotation and transmit a rotational movement to a core during at least a part of the winding cycle of each log.

35. The rewinding machine as claimed in claim 32, wherein said core engaging members are driven into rotation and transmit a rotational movement to a core during at least a part of the winding cycle of each log.

36. The rewinding machine as claimed in claim 32, wherein said core engaging members are constructed and arranged to engage said winding cores near an axial end thereof.

37. A rewinding machine for winding web material in logs about winding cores, comprising a first winding roller and a second winding roller defining a nip through which winding cores pass and through which web material is fed; and two core engaging members, said engaging members and said first winding roller and said second winding roller being constructed and arranged so that a log being formed is in contact with said first winding roller and said second winding roller over at least part of a winding cycle; and wherein said rewinding machine further comprises a third winding roller defining a winding space with said first winding roller and said second winding roller, said third winding roller being movable to allow increase of each log in said winding space, wherein said two core engaging members rotate around their own axes, and said core engaging members having a core contacting surface for contacting and engaging an inner surface of said winding cores, wherein engagement between the core engaging members and the winding cores is such as to transmit rotational motion from the core engaging members to the winding cores.

38. The rewinding machine as claimed in claim 37, further comprising a core insertion channel and a core insertion device, said core insertion device sequentially introducing said winding cores into said channel.

39. The rewinding machine as claimed in claim 38, wherein said channel is formed by one of said first winding roller and said second winding roller and a stationary surface developing around said winding roller, said core insertion device introducing a core into said channel in contact with said surface and said web material.

40. The rewinding machine as claimed in claim 39, wherein said channel extends towards said nip.

41. The rewinding machine as claimed in claim 39, wherein said core insertion channel extends from an inlet end to an outlet end, said outlet end being adjacent said nip, said channel extending around said first winding roller and said core engaging members arranged and controlled to engage said core adjacent said outlet end of said channel.

42. The rewinding machine as claimed in claim 37, wherein said core engaging members move along a substantially rectilinear trajectory.

43. A rewinding machine for winding web material in logs about winding cores, comprising a first winding roller and a second winding roller defining a nip through which winding cores pass and through which web material is fed; and core engaging members, said engaging members and said first winding roller and said second winding roller being constructed and arranged so that a log being formed is in contact with said first winding roller and said second winding roller over at least part of a winding cycle; and wherein said rewinding machine further comprises a third winding roller defining a winding space with said first winding roller and said second winding roller, said third winding roller being movable to allow increase of each log in said winding space, wherein said core engaging members are expandable to engage said winding core at an inner surface of said winding core, said winding core being tubular; and wherein said core engaging members rotate around their own axes, and engagement between the core engaging members and the winding core is such as to transmit rotational motion to the core.

44. A rewinding machine for winding web material in logs about winding cores, comprising a first winding roller, a second winding roller and a third winding roller, said first winding roller, said second winding roller and said third winding roller forming a winding cradle for winding said web material around winding cores; a web feeding device for substantially continuously feeding a web material toward said winding cradle; a core insertion channel adjacent one of said first winding roller, said second winding roller and said third winding roller; a core inserter, for sequentially introducing cores into said channel in contact with said web material; and core engaging members for engaging said cores during at least a portion of a winding cycle, wherein said third winding roller is supported by at least a first arm oscillating about a first axis of oscillation, wherein a first actuator to control oscillation of said first arm is associated with said first arm, and wherein said first axis of oscillation is carried by a movable element.

45. A method of winding logs of web material around winding cores, comprising:

arranging a first winding roller, a second winding roller and a third winding roller having a movable axis to form a winding cradle;

substantially continuously feeding a web material towards said winding cradle;

sequentially introducing winding cores towards said winding cradle; and engaging said winding cores by at least one core engaging member while winding said web material around said winding core in said winding cradle to form a log in contact with said first winding roller, said second winding roller and said third winding roller, wherein said core engaging member is motor driven, said core engaging member transmitting rotation to said core while said log is contacting said first winding roller, said second winding roller and said third winding roller.

46. The method as claimed in claim 45, including steps of:

arranging a core insertion channel around one of said first winding roller, said second winding roller and said third winding roller;

sequentially feeding cores into said channel;

engaging a leading edge of said web material with a first core;

starting winding said web material around said first core;

engaging said first core with said at least one core engaging member; and further winding said web material around said first core to form said log, with said log in contact with said first winding roller, said second winding roller and said third winding roller.

47. A method of winding logs of web material around winding cores, comprising arranging a first winding roller, a second winding roller and a third winding roller having a movable axis to form a winding cradle;

substantially continuously feeding a web material towards said winding cradle;

sequentially introducing winding cores towards said winding cradle;

in a core engaging position engaging said winding cores by core engaging members, said core engaging members being motor-driven;

rotating said winding cores in said winding cradle in contact with said first winding roller, said second winding roller and said third winding roller while engaged by said core engaging members, forming said log.

48. The method as claimed in claim 47, further comprising moving at least one of said first winding roller, said second winding roller and said third winding roller away from remaining winding rollers for controlled increase of a diameter of said log in said winding cradle, and moving said core engaging members along a core advancing trajectory following said increase in log diameter.

49. The method as claimed in claim 48, further comprising disengaging said core engaging members from said core;

moving said core engaging members towards an initial core engagement position, while continuing winding said web material around said log in said winding cradle;

discharging said log from said winding cradle.

50. The method as claimed in claim 47, wherein said core engaging members engage said cores after starting winding of said web material around said cores to form logs.

51. The method as claimed in claim 50, wherein said core engaging members disengage said cores before winding of said logs has been completed.

52. A rewinding machine for winding web material in logs about winding cores, comprising a first winding roller and a second winding roller defining a nip through which winding cores are inserted and through which web material is fed; and at least one pair of motorized engaging members constructed and arranged to engage ends of a winding core and transmit a rotational movement to the winding core during at least a part of a winding cycle of each log, said engaging members and said first winding roller and said second winding roller being constructed and arranged so that a log being formed is in contact with said first winding roller and said second winding roller; wherein said rewinding machine further includes a third winding roller, defining a winding space with said first winding roller and said second winding roller, said third winding roller being movable to allow increase and completion of winding of each log in said winding space, wherein said third winding roller is supported by at least a first arm oscillating about a first axis of oscillation, wherein a first actuator to control oscillation of said first arm is associated with said first arm, and wherein said first axis of oscillation is carried by a movable element.

53. The rewinding machine as claimed in claim 52, including a single pair of said engaging members.

54. The rewinding machine as claimed in claim 52, wherein the engaging members are disposed and controlled to engage each core after the core has been brought into rotation and into contact with the web material.

55. The rewinding machine as claimed in claim 52, wherein the engaging members are constructed and arranged to disengage from a core before winding of a log on the core has been completed.

56. The rewinding machine as claimed in claim 52, further comprising a core inserter to sequentially insert the winding cores into the nip between the first winding roller and the second winding roller, each core inserted by said core inserter being subsequently engaged by said engaging members.

57. The rewinding machine as claimed in claim 56, further comprising a rolling surface extending around said first winding roller upstream of said nip, said core inserter being constructed and arranged to insert the cores between the first winding roller and the rolling surface, said engaging members being controlled to engage each core downstream of said rolling surface or at a level of an end area of the rolling surface.

58. The rewinding machine as claimed in claim 52, wherein each of said engaging members comprises at least one inflatable chamber to clamp the winding core.

59. The rewinding machine as claimed in claim 52, wherein said at least one inflatable chamber has an annular extension.

60. The rewinding machine as claimed in claim 52, wherein said at least one inflatable chamber is arranged on a head supported revolvingly on a fixed hollow central shaft, connected to a source of pressurized fluid, said head being provided with an axial movement of insertion and extraction with respect to the winding cores.

61. The rewinding machine as claimed in claim 60, wherein said head is torsionally coupled to a rotating sleeve drawn in rotation to make said head rotate.

62. The rewinding machine as claimed in claim 61, wherein said rotating sleeve and said head are coupled by a splined coupling.

63. A rewinding machine for winding web material in logs about winding cores, comprising a first winding roller, a second winding roller and a third winding roller, said first winding roller, said second winding roller and said third winding roller forming a winding cradle for winding said web material around winding cores; a web feeding device for substantially continuously feeding a web material toward said winding cradle; a core insertion channel adjacent one of said first winding roller, said second winding roller and said third winding roller; a core inserter, for sequentially introducing cores into said channel in contact with said web material; and core engaging members for engaging said cores during at least a portion of a winding cycle, wherein said third winding roller is supported by at least a first arm oscillating about a first axis of oscillation, a first actuator to control oscillation of said first arm is associated with said first arm, said first axis of oscillation is supported by at least a second arm oscillating about a second axis of oscillation, and a second actuator is associated to said second arm to control oscillation thereof, said first axis of oscillation and said second axis of oscillation being substantially parallel to each other.

64. The rewinding machine as claimed in claim 63, wherein said first winding roller and said second winding roller define a nip through which said cores pass and through which said web material is fed.

65. The rewinding machine as claimed in claim 64, wherein said core engaging members are arranged and controlled to engage said cores exiting said channel near or at said nip.

66. The rewinding machine as claimed in claim 65, wherein said core engaging members are motor-driven.

* * * * *